US008375962B2

(12) United States Patent
Gibis et al.

(10) Patent No.: US 8,375,962 B2
(45) Date of Patent: Feb. 19, 2013

(54) DOSAGE ELEMENT AND CHAMBER

(75) Inventors: Karl Ludwig Gibis, Limburgerhof (DE); Chris Efstathios Housmekerides, Ludwigshafen (DE)

(73) Assignee: Reckitt Benckiser N. V., Hoofddorp (NL)

( * ) Notice: Subject to any disclaimer, the term of this patent is extended or adjusted under 35 U.S.C. 154(b) by 771 days.

(21) Appl. No.: 12/160,909

(22) PCT Filed: Jan. 19, 2007

(86) PCT No.: PCT/GB2007/000177

§ 371 (c)(1),
(2), (4) Date: Jul. 15, 2008

(87) PCT Pub. No.: WO2007/083141

PCT Pub. Date: Jul. 26, 2007

(65) Prior Publication Data

US 2009/0308414 A1 Dec. 17, 2009

(30) Foreign Application Priority Data

Jan. 21, 2006 (GB) ..... 0601247.0
Oct. 30, 2006 (GB) ..... 0621580.0
Oct. 30, 2006 (GB) ..... 0621582.6

(51) Int. Cl.
*B08B 3/00* (2006.01)

(52) U.S. Cl. ..... 134/93; 68/17 R

(58) Field of Classification Search ..... 134/93; 68/17 R

See application file for complete search history.

(56) References Cited

U.S. PATENT DOCUMENTS

| | | | | |
|---|---|---|---|---|
| 2,315,890 | A * | 4/1943 | Bader | 206/0.5 |
| 2,370,609 | A | 2/1945 | Wilson | |
| 2,514,000 | A | 7/1950 | Kent | |
| 2,777,570 | A | 1/1957 | Mytinger | |
| 2,880,077 | A * | 3/1959 | Floria | 422/266 |
| 2,954,145 | A | 9/1960 | McCauley | |
| 3,063,459 | A | 11/1962 | Jacobs | |
| 3,091,402 | A | 5/1963 | Palmer | |
| 3,187,767 | A | 6/1965 | Sherrard | |
| 3,198,010 | A | 8/1965 | Huston | |
| 3,272,899 | A | 9/1966 | Diamond et al. | |

(Continued)

FOREIGN PATENT DOCUMENTS

| | | | |
|---|---|---|---|
| CA | 2235889 | A1 | 10/1999 |
| CA | 2313356 | A1 | 1/2001 |

(Continued)

OTHER PUBLICATIONS

European Patent Office 1 493 375 Jan. 2005.*

(Continued)

*Primary Examiner* — Michael Barr
*Assistant Examiner* — Jason Ko
(74) *Attorney, Agent, or Firm* — Norris McLaughlin & Marcus PA

(57) ABSTRACT

This invention relates to a dosage element of cleaning composition and an associated chamber for use in a ware washing machine, for example a dishwashing machine or a laundry washing machine. The dosage element and chamber are particularly useful in the context of forming part of a multi-dosing detergent delivery device and/or a refill for such a device. The element supports various different configurations of ingress and egress holes for an efficient dissolution of cleaning composition.

21 Claims, 8 Drawing Sheets

U.S. PATENT DOCUMENTS 3,411,671 A 11/1968 Harvey et al.
3,482,740 A 12/1969 Evans et al.
3,494,436 A 2/1970 Lanning
3,688,795 A 9/1972 Taylor
3,759,284 A 9/1973 Crowley et al.
3,822,561 A 7/1974 Miller
4,055,278 A 10/1977 Seymour
D269,801 S 7/1983 Sangster et al.
4,416,859 A 11/1983 Brown et al.
D273,033 S 3/1984 Sangster et al.
4,436,269 A 3/1984 Dirksing et al.
D280,757 S 9/1985 Paulovich et al.
4,545,917 A * 10/1985 Smith et al. ..... 510/224
4,700,554 A 10/1987 Eichman et al.
4,707,866 A 11/1987 von Philipp et al.
4,835,804 A 6/1989 Arnau-Munoz et al.
D304,102 S 10/1989 Lakhan et al.
4,917,272 A 4/1990 Ikeda
D308,739 S 6/1990 Nystuen
4,999,124 A 3/1991 Copeland
5,033,643 A 7/1991 Schumacher
5,088,517 A 2/1992 Bersch
D328,332 S 7/1992 Fink
D328,333 S 7/1992 Casberg
5,137,694 A 8/1992 Copeland et al.
5,186,912 A * 2/1993 Steindorf et al. ..... 422/263
5,194,230 A 3/1993 PeKarna et al.
5,251,777 A 10/1993 McMahon
5,262,132 A 11/1993 Bricker et al.
D346,890 S 5/1994 Panesar
5,310,060 A 5/1994 Bitner et al.
5,310,430 A 5/1994 McCall
5,474,211 A 12/1995 Hellenberg
5,500,050 A 3/1996 Chan
5,549,074 A 8/1996 Hui
D376,320 S 12/1996 Lathrop et al.
5,603,233 A 2/1997 Erickson
D381,141 S 7/1997 Balz
5,643,591 A 7/1997 Mehra et al.
D383,264 S 9/1997 Balz
5,679,173 A 10/1997 Hartman
5,681,400 A 10/1997 Brady
5,685,178 A 11/1997 Ahn
5,785,180 A 7/1998 Dressel et al.
5,807,906 A 9/1998 Bonvallot et al.
5,830,576 A 11/1998 Mehra et al.
5,870,906 A 2/1999 Denisar
5,967,158 A * 10/1999 Smith et al. ..... 134/25.2
5,971,154 A 10/1999 Toren
6,048,501 A * 4/2000 Lemaire et al. ..... 422/266
6,058,946 A 5/2000 Bellati et al.
6,173,743 B1 1/2001 Ibanez Sapina et al.
6,178,987 B1 1/2001 Caruthers, Jr.
6,263,708 B1 7/2001 Yarmosky
6,375,038 B1 4/2002 Daansen et al.
6,375,956 B1 4/2002 Hermelin et al.
D457,596 S 5/2002 Guzman et al.
6,463,766 B2 10/2002 Kubota et al.
D465,258 S 11/2002 Hiranaga et al.
6,540,081 B2 4/2003 Balz et al.
6,571,993 B2 6/2003 Rodd et al.
6,576,599 B1 6/2003 Stone
6,581,800 B2 6/2003 Rodd et al.
6,589,925 B1 7/2003 Binstock et al.
6,608,022 B1 8/2003 Fletcher et al.
D481,844 S 11/2003 Greene et al.
6,681,963 B2 1/2004 Hague et al.
D513,928 S 1/2006 Birdsell et al.
D526,043 S 8/2006 Thompson
D529,128 S 9/2006 Lee
7,156,353 B2 1/2007 Kringel et al.
7,188,521 B2 3/2007 Fling et al.
D539,993 S 4/2007 Brandt
7,219,518 B2 5/2007 Aouad et al.
D547,912 S 7/2007 Brandt
7,276,470 B2 * 10/2007 Hahn ..... 510/224
D564,141 S 3/2008 Gaa et al.
D564,142 S 3/2008 Gaa et al.
D564,143 S 3/2008 Gaa et al.
D568,555 S 5/2008 Gaa et al.
7,421,867 B2 9/2008 Bongini
7,428,831 B2 9/2008 Cho et al.
D601,766 S 10/2009 Gaa et al.
D604,466 S 11/2009 Gaa et al.
D608,960 S 1/2010 Gaa et al.
7,913,639 B2 3/2011 Canavoi et al.
2001/0010165 A1 8/2001 Kubota et al.
2002/0004472 A1 1/2002 Holderbaum et al.
2002/0108969 A1 8/2002 Rodd et al.
2002/0117187 A1 8/2002 Helminger
2002/0169092 A1 11/2002 Catlin et al.
2003/0052138 A1 3/2003 Smith
2003/0168085 A1 9/2003 Sowle et al.
2003/0182732 A1 10/2003 Davenet et al.
2004/0011693 A1 1/2004 Prenger et al.
2004/0053808 A1 3/2004 Raehse et al.
2004/0088796 A1 5/2004 Neergaard et al.
2004/0103925 A1 6/2004 Marettek
2004/0206133 A1 10/2004 Woo et al.
2004/0216499 A1 11/2004 Bongini
2004/0217125 A1 11/2004 Marone
2005/0023290 A1 2/2005 Kon et al.
2005/0039781 A1 2/2005 Song et al.
2005/0109860 A1 5/2005 Chiang et al.
2005/0121058 A1 6/2005 Furber
2005/0139241 A1 6/2005 Jowett et al.
2005/0148479 A1 7/2005 Barthel
2005/0235704 A1 10/2005 Cho et al.
2006/0258556 A1 11/2006 Holderbaum et al.
2007/0000068 A1 1/2007 Gerard France et al.
2007/0295036 A1 12/2007 Brandt et al.
2008/0053187 A1 3/2008 Koring
2008/0053494 A1 * 3/2008 Moro et al. ..... 134/113

FOREIGN PATENT DOCUMENTS

DE 2244722 A1 10/1973
DE 3513640 A1 10/1986
DE 8814550 U1 1/1989
DE 4400417 A1 7/1995
DE 195 16 312 * 8/1996
DE 19516312 C1 8/1996
DE 19540608 5/1997
DE 19652733 A1 6/1998
DE 19740819 A1 3/1999
DE 19740819 5/1999
DE 19836857 2/2000
DE 19930771 A1 1/2001
DE 10044495 A1 10/2002
EP 0391087 A1 10/1990
EP 0 457 137 5/1991
EP 0481547 4/1992
EP 0521179 1/1993
EP 0863200 A2 9/1998
EP 0903405 A2 3/1999
EP 0906747 4/1999
FR 2723751 A1 2/1996
FR 2723752 2/1996
GB 820327 9/1959
GB 1142238 2/1969
GB 1198251 7/1970
GB 2037719 A 7/1980
GB 1592357 7/1981
GB 2104109 A 3/1983
GB 2134654 A 8/1984
GB 2244722 A 12/1991
GB 2339678 2/2000
GB 2339678 A 2/2000
GB 2356842 6/2001
GB 2386129 9/2003
GB 2386130 A 9/2003
GB 2402604 A 12/2004
GB 2402679 A 12/2004
GB 2406821 A 4/2005
GB 2417492 A 3/2006
JP 01-317493 12/1989

| | | | |
|---|---|---|---|
| JP | 2000317350 | A | 11/2000 |
| JP | 2003260130 | A | 9/2003 |
| JP | 2006061450 | | 3/2006 |
| JP | 2006122196 | A | 5/2006 |
| KR | 950002460 | B1 | 3/1995 |
| SU | 838371 | B | 6/1981 |
| WO | 8806199 | A1 | 8/1988 |
| WO | 96 38638 | | 12/1996 |
| WO | 9638638 | A | 12/1996 |
| WO | 9712539 | | 4/1997 |
| WO | 0107702 | A | 2/2001 |
| WO | 0107703 | A1 | 2/2001 |
| WO | 0178572 | A2 | 10/2001 |
| WO | 0220893 | A | 3/2002 |
| WO | 0276278 | | 3/2002 |
| WO | 02051704 | A1 | 7/2002 |
| WO | 02058528 | A1 | 8/2002 |
| WO | 03 07 39 06 | | 9/2003 |
| WO | 0373907 | A2 | 9/2003 |
| WO | 2004033297 | A2 | 4/2004 |
| WO | 2004041248 | | 4/2004 |
| WO | 2004044303 | A | 5/2004 |
| WO | 2004059068 | | 7/2004 |
| WO | 2004 08 55 95 | | 10/2004 |
| WO | 2005099552 | A2 | 10/2005 |
| WO | 2006000237 | A1 | 1/2006 |
| WO | 2006021760 | A1 | 3/2006 |
| WO | 2006021760 | A2 | 3/2006 |
| WO | 2006021761 | A | 3/2006 |
| WO | 2006021773 | A1 | 3/2006 |
| WO | 2007 05 19 89 | | 5/2007 |
| WO | 2007 083142 | A1 | 7/2007 |
| WO | 2007083142 | A1 | 7/2007 |

OTHER PUBLICATIONS

English-Language Translation of EP 09 06 747 A2.
English Abstract for DE3513640 published Oct. 16, 1986.
English Abstract for KR950002460 published Mar. 20, 1995.
English Translation of DE8814550 published Jan. 19, 1989.
English language translation of EP 0863200 published Sep. 9, 1998.
English language translation for EP 0931087 published Oct. 10, 1990.
English language translation for DE 10044495 published Oct. 24, 2002.
English language translation for DE 4400417 published Jul. 13, 1995.
International Search Report PCT/GB2005/003271.
Written Opinion PCT/GB2005/003271.
Written Opinion PCT/GB2005/003265.
International Search Report PCT/GB2005/003265.
English Translation of Application FR 2723751 taken from esp@net.com.
English Translation of Application DE 19740819 A1 taken from esp@net.com.
English Translation application DE 19516312 C1 taken from esp@net.com.
English Translation of EP 0906747 provided by esp@cenet.
English Abstract of JP 2000-317350 taken from espa@net.
English Abstract of JP 2003-260130 taken from espa@net.
English Abstract of JP 2006-122196 taken from espa@net.
English Abstract of KR 2002001154 in Office Action dated Oct. 26, 2011 of related U.S. Appl. No. 12/447,509.

* cited by examiner

DOSAGE ELEMENT AND CHAMBER

This is an application filed under 35 USC 371 of PCT/GB2007/000177.

This invention relates to a dosage element of cleaning composition and an associated chamber for use in a ware washing machine, for example a dishwashing machine or a laundry washing machine. The dosage element and chamber are particularly useful in the context of forming part of a multi-dosing detergent delivery device and/or a refill for such a device.

In accordance with a first aspect of the present invention there is provided a dosage element of cleaning composition and a chamber for use in a ware washing machine, wherein said chamber comprises a container for said dosage element and comprises at least an upper opening/top hole and a lower opening/bottom hole for permitting ingress and egress of water/wash liquor to/from the chamber.

Preferably said chamber retaining a dosage element comprises a sleeve, for example of a plastics material. Alternatively any other suitable material may be used, such as, cardboard-based material (especially covered by a water-resistant material). Laminated cardboard with a suitable laminate is one material which may be used. Preferably each sleeve has two openings, at opposite ends so that water/wash liquor may enter at one end (the upper end in use) and leave the other end (the lower end in use), carrying with it dissolved or broken away cleaning composition.

An upper opening may suitably be of area at least 10 $mm^2$, preferably at least 30 $mm^2$, and most preferably up to 70 mm2. Suitably said upper opening may be of approximately 50 mm2.

In a first preferred embodiment, the lower opening may suitably be of a similar or identical size to the top opening.

In a second preferred embodiment, said upper hole is larger than said bottom hole.

In the second embodiment there is preferably provided a middle opening intermediate said upper and lower openings. Said middle opening may be larger than said lower opening and smaller than said upper opening.

In said second embodiment, said upper opening is preferably in a range of 15 mm2 to 40 mm2 and suitably of approximately 28 mm2, said lower opening is preferably in a range of 3 mm2 to 8 mm2 and suitably of approximately 5 mm2 and said middle opening is preferably in the range of 5 mm2 to 10 mm2 and suitably of approximately 7 mm2.

According to a second aspect of the invention, there is provided an article comprising a rack of dosage elements and chambers in accordance with the first aspect, wherein said chambers are retained on a backing material. Preferably, said rack is formable into a nested form.

The rack may be in the form of a parallel array of elongate chambers containing solid dosage elements.

The article can be made in flat form, and formed into the nested form, and inserted into a holder, located, or to be located, in a ware washing machine.

Preferably the nested form is generally cylindrical.

Preferably, in the nested form, the backing material is on the outside and so the dosage elements project inwards. However embodiments in which, in the nested form, the backing material is on the inside and so the dosage elements project outwards are not excluded, e.g. a central core of backing material with dosage elements attached thereto and projecting outwards.

Preferably the dosage elements are in the form of rods or sticks, and are held substantially parallel to each other on the backing material. Alternatively, the dosage elements may be in the form of a viscous gel or paste, such gel or paste preferably being sufficiently viscous to remain within the container until such time as it is contacted with water to flush it out of the container.

Preferably the article contains at least 6 dosage elements, more preferably at least 8, and most preferably at least 10.

Preferably the article contains up to 20 dosage elements, more preferably up to 18, and most preferably up to 16.

Preferably the backing material is a sheet or is made up of a series of portions, for example panels, articulated together such that the nested form may be achieved. When the backing material is a sheet the article may be formed into a nested form by rolling it, preferably until one end touches or even overlaps the other end. When the backing material is a series of portions articulated together the article may be formed into a nested form by rolling or folding it, preferably until one end reaches or overlaps the other end.

Preferably the nested form is maintained by securing one part of the backing material to another part; preferably one end to the other end. The securement means may conveniently be adhesive tape located so as to prevent unrolling or unfolding of the article, as the case may be.

Preferably there is a small gap between chambers containing dosage elements in the non-nested position so that they can be formed into their nested position without hindrance.

Preferably the sleeves are formed in one piece. That piece may be in the form of a moulded or thermoformed tray having multiple compartments, into which the dosage elements are placed. The backing material may be secured over the tray to entrap the dosage elements. In such an embodiment the tray and backing material together form the sleeves.

The dosage elements are of a solid cleaning composition and as such may be of a particulate material, for example powder or granules, provided that the material is retained until it is washed away in use; for example in a sleeve as described above. Preferably however the dosage elements are of a solid cleaning composition in the sense of being non-flowable. Preferably they are of a coherent mass; preferably formed by a moulding or shaping process, for example injection moulding, extrusion, casting or compression forming.

Preferably the dosage elements are identical to each other.

Preferably the dosage elements are of substantially the same cross-section along their length; in particular, they preferably do not taper.

Preferably the article is such that, in its nested form, each pair of chambers containing dosage elements is separated by a spacing, at least for part of the depth of the dosage elements. The spacing preferably extends part-way towards the backing; for example between one-third and two-thirds of the distance to the backing. The separate holder into which the nested article is placed, in use, preferably has an array of walls radiating from a hub, wherein spacings must be mated with divider walls when the article is located in the holder. There could be one-to-one correspondence between spacings and divider walls, but preferably there are more spacings than divider walls. Three or four divider walls will generally suffice to cause the article to be located correctly in the holder. In general we may say there is preferably 3-8 divider walls, preferably 4-6.

The holder is generally a plastics body, rigid and substantial, but the article, once the dosage elements have gone, is light and may even be rather flimsy. It suitably comprises just the backing material and the sleeves (which may be light thermoformed sheet, or film). The article is intended as a refill, the holder retained. The wastage of material when the article is exhausted is very small. The invention may thus be seen as a desirably ergonomic solution.

In this first aspect of the invention the holder is not part of the invention. In accordance with a second aspect of the invention there is provided a multiple dosing ware washing product comprising an article as defined above, in nested form, retained within a holder as described above.

Preferably the holder has means for retaining it releasably within a ware washing machine. For example it may have a hook to enable it to be hung from a rack of a dishwasher; or a clamp to enable it to be clamped to a rack of a dishwasher; or be designed to be fitted into a compartment of a rack of a dishwasher; or may have means allowing it to be releasably fitted to the wall of a dishwasher or laundry washing machine, or to the window of a laundry washing machine.

Preferably the holder has a lid adapted to deliver water to a selected dosage element. Preferably the holder has means to deliver water to the dosage elements in sequence, one in each wash. Such means may operate automatically or be operated by the user, before a wash is commenced.

In accordance with a third aspect of the invention there is provided a method of making an article in accordance with the first aspect, comprising forming a tray comprising a rack of cavities, introducing cleaning composition into the cavities, and sealing the cavities with said backing sheet, and forming the article into said nested form.

The tray may be of a plastics material and is preferably formed by a moulding process; preferably thermoforming.

The cleaning composition may be cast into the cavities or introduced into the cavities as already-formed dosage elements. They may suitably be formed by injection moulding or extrusion.

In accordance with a fourth aspect of the invention there is provided a method of carrying out washing in a ware washing machine, the method comprising inserting an article of the first aspect containing a plurality X of dosage elements into a said holder, operating the ware washing machine for X cycles, removing the spent article, inserting a new article, and operating the ware washing machine for further cycles.

In accordance with a fifth aspect of the invention there is provided the use of an article in accordance with the first aspect or of a multiple dosing ware washing product in accordance with the second aspect, in carrying out washing in a ware washing machine. Preferably, there are provided free channels between the dosage element and at least some inner wall areas of the chamber.

Preferably, there is provided free space in the chamber above the dosage element.

Preferably, there is provided free space in the chamber below the dosage element.

Preferably, there is provided a channel of free space within the chamber linking the free space area above the dosage element to the free space area below the dosage element.

By providing such free spaces, there is thereby assured a water flow through the chamber right from the beginning of a wash cycle.

Preferably, there is provided free space in the chamber between the middle opening and the dosage element.

The following definitions of dosage elements of the invention apply both to dosage elements which are monolithic and to dosage elements constituted by two or more pieces set end-to-end. In the latter embodiments the following definitions treat such dosage elements as if they were monolithic; for example length denotes the consolidated length, and surface area denotes the surface area of the dosage elements set end-to-end, not the summated surface area of the separated pieces.

Preferably the length (that is, the minimum length—see above) of a dosage element is at least 4 cm, preferably at least 5 cm, preferably at least 6 cm.

Preferably the length of a dosage element is up to 14 cm, preferably up to 12 cm, preferably up to 10 cm.

Preferably the thickness (that is, the maximum thickness—see above) of a dosage element is at least 0.8 cm, preferably at least 1.4 cm, preferably at least 1.8 cm.

Preferably the thickness of a dosage element is up to 5 cm, more preferably up to 3.5 cm, more preferably up to 2.5 cm.

Preferably the cross-sectional area (that is, the maximum cross-sectional area—see above) of a dosage element is at least 0.6 $cm^2$, preferably at least 1 $cm^2$, preferably at least 1.5 $cm^2$.

Preferably the cross-sectional area of a dosage element is up to 5 $cm^2$, preferably up to 3.5 $cm^2$, more preferably up to 2.5 $cm^2$.

Preferably the surface area of a dosage element is at least 30 $cm^2$, preferably at least 35 $cm^2$, preferably at least 40 $cm^2$.

Preferably the surface area of a dosage element is up to 60 $cm^2$, preferably up to 55 $cm^2$, preferably up to 50 $cm^2$.

Preferably the volume of a dosage element is at least 6 ml, preferably at least 9 ml, preferably at least 12 ml.

Preferably the volume of a dosage element is up to 25 ml, preferably up to 20 ml, preferably up to 16 ml.

Preferably the weight of a dosage element is at least 8 g, preferably at least 12 g, preferably at least 15 g.

Preferably the weight of a dosage element is up to 32 g, preferably up to 26 g, preferably up to 24 g.

Preferably a dosage element has an aspect ratio (that is, the ratio of minimum length to maximum thickness—see above) of at least 2:1, preferably at least 2.5:1, preferably at least 3:1.

Preferably a dosage element has an aspect ratio of up to 12:1, preferably up to 8:1, preferably up to 6:1.

Preferably a dosage element has a ratio of length to cross-sectional area of at least 2:1, preferably at least 2.5:1, preferably at least 3:1 (units of $length^{-1}$).

Preferably a dosage element has a ratio of length to cross-sectional area of up to 12:1, preferably up to 8:1, preferably up to 6:1 (units of $length^{-1}$).

Preferably a dosage element has a ratio of surface area to volume of at least 1.5:1, preferably at least 2:1, preferably at least 3:1 (units of $length^{-1}$).

Preferably a dosage element has a ratio of surface area to volume of up to 8:1, preferably up to 6:1, preferably up to 4:1 (units of $length^{-1}$).

The invention will now be further described, by way of example, with reference to the accompanying drawings, in which.

Figure 1:
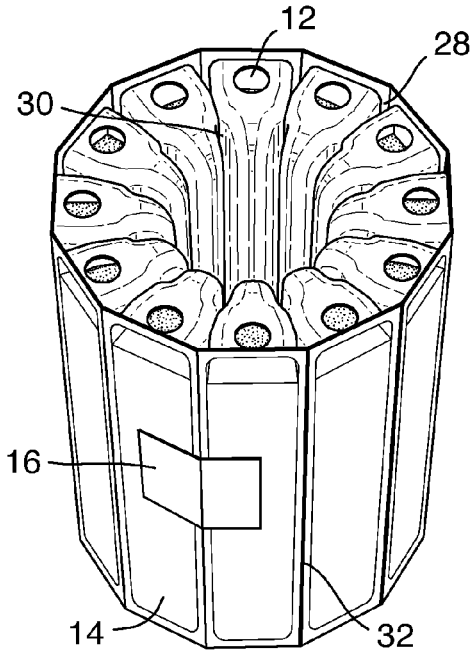
FIG. 1 shows an article of the present invention in nested form, in a perspective view, generally from above.
Figure 5A:
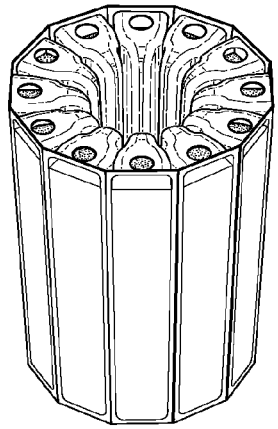
Figure 5B:
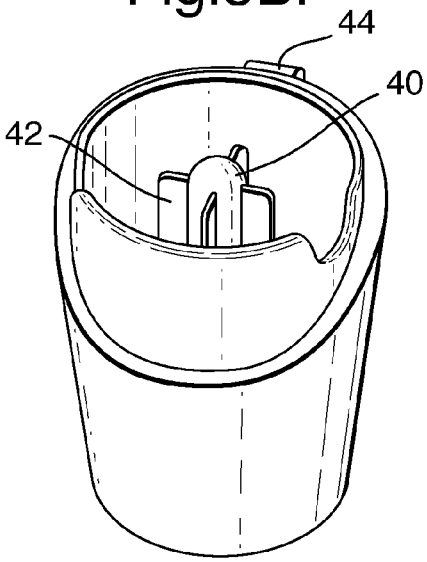
Figure 5C:
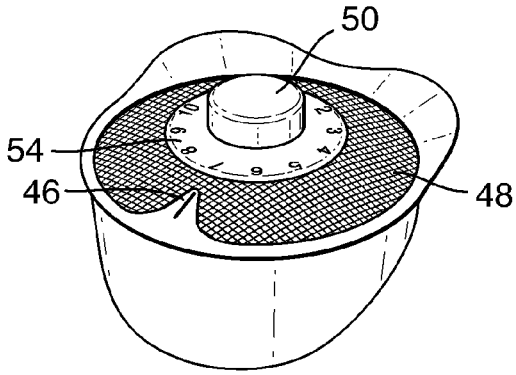

FIG. 5*a* shows the article of FIG. 1 being introduced into a holder of FIG. 5*b*, the cap, containing the dosage element selecting device, being shown removed, as FIG. 5*c;*

Figure 6:
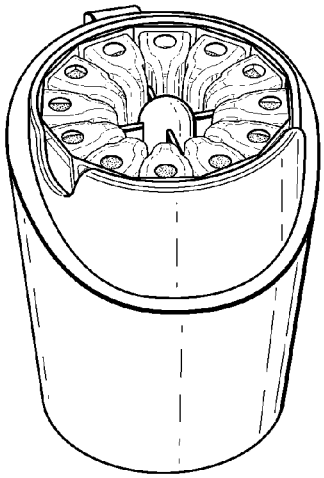

FIG. 6 shows the article of FIG. 1 having been located within the holder of FIG. 5*b;*

Figure 7:
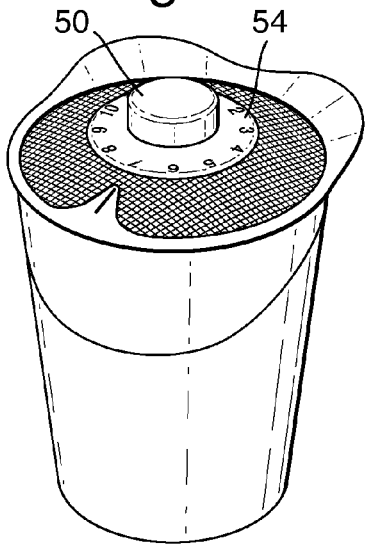

FIG. 7 shows the fully assembled device, with the cap of FIG. 5*c* having been placed on the holder and article assembly of FIG. 6*a;*

Figure 8:
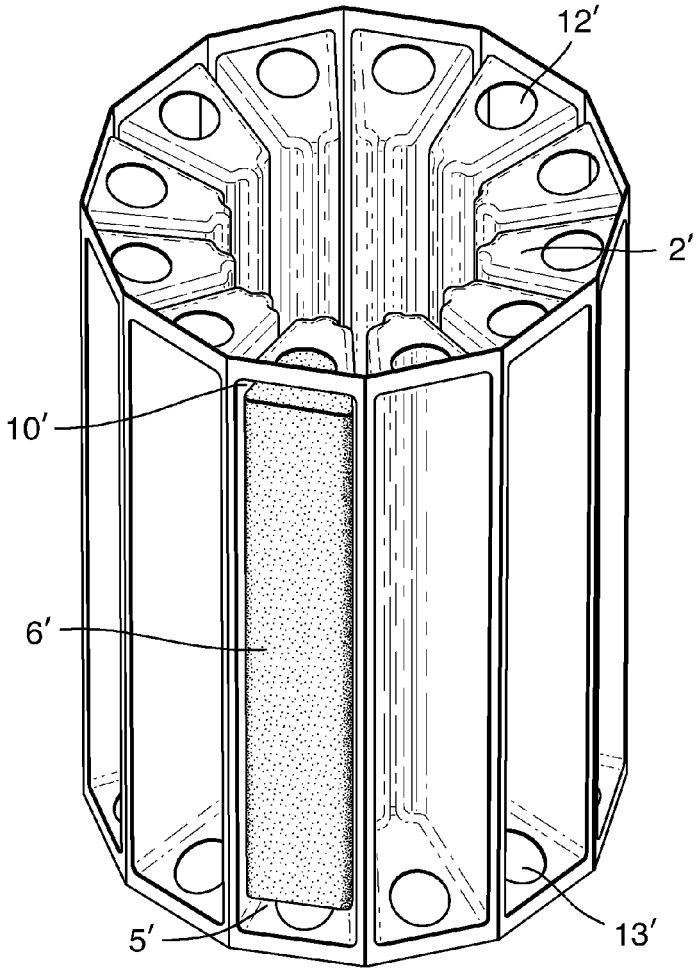
Figure 9A:
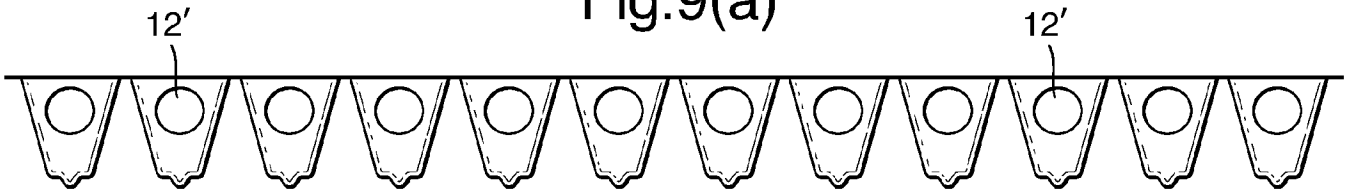
Figure 9B:
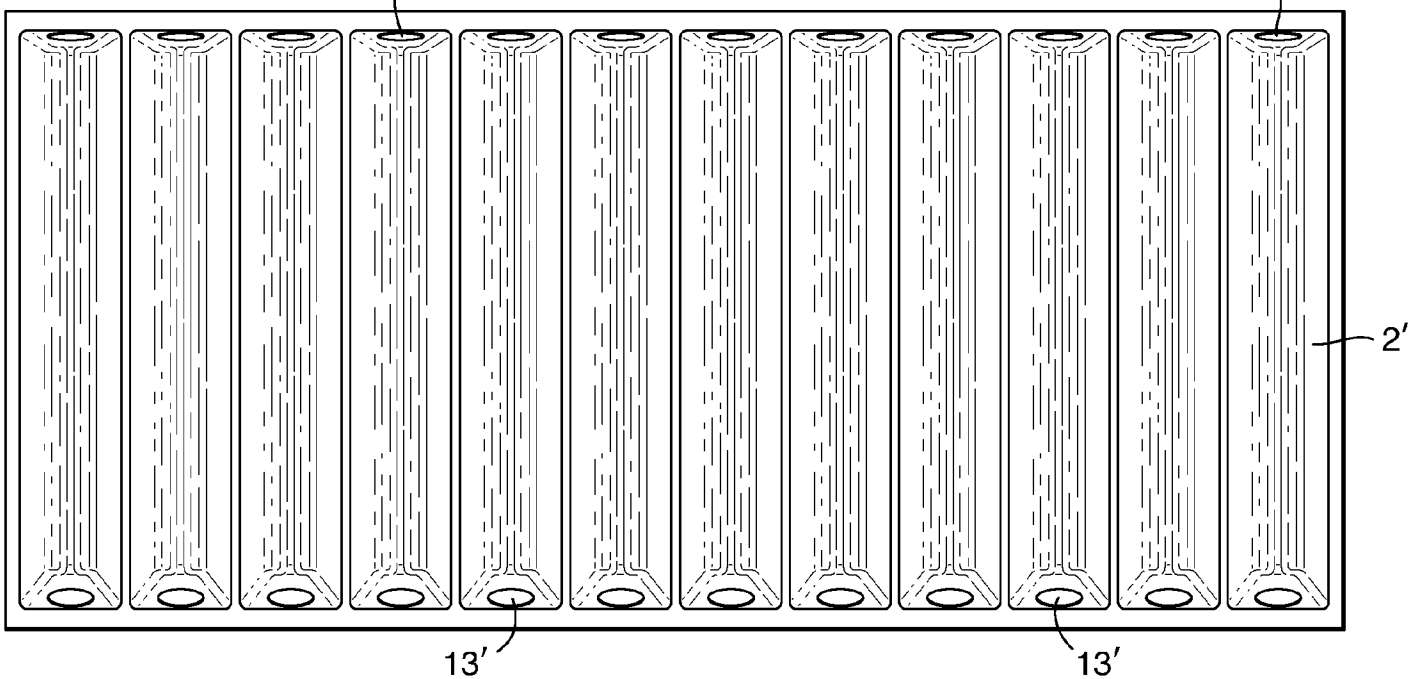
Figure 10:
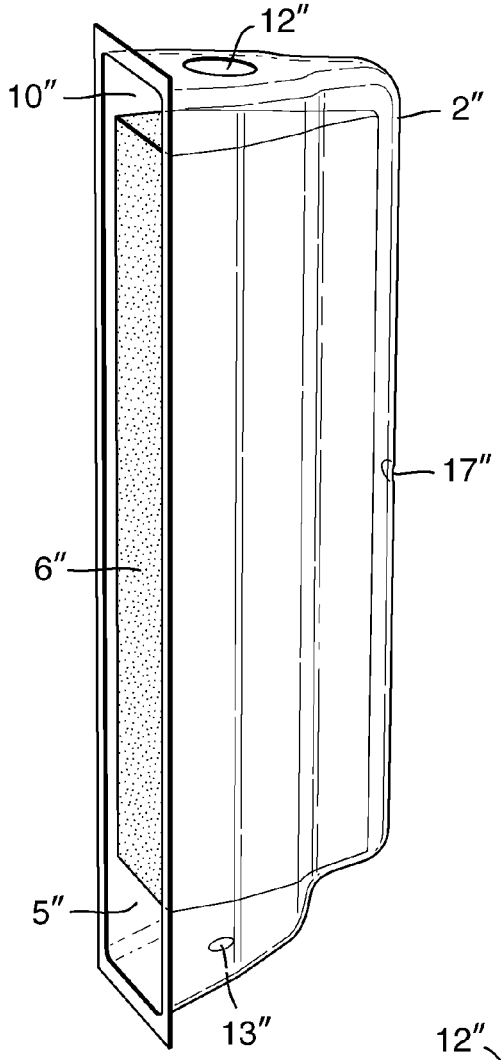
Figure 12:
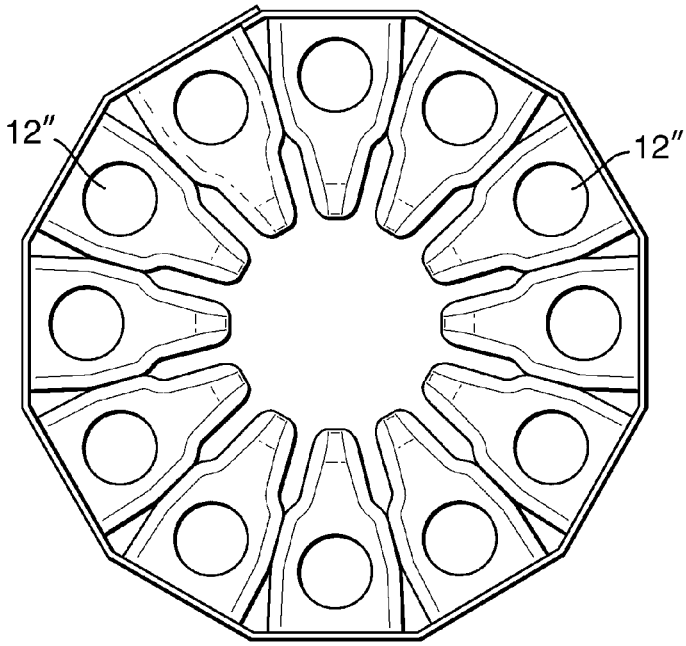
Figure 11A:
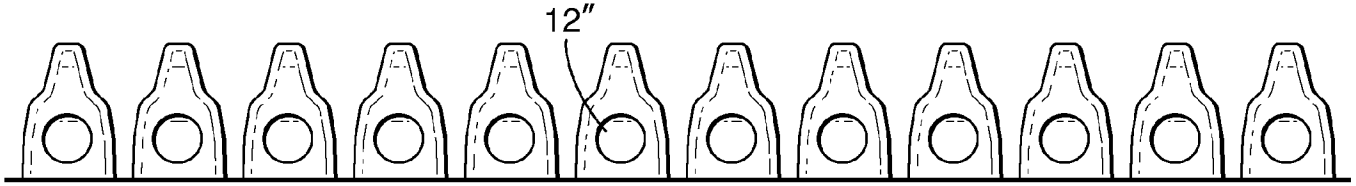
Figure 11B:
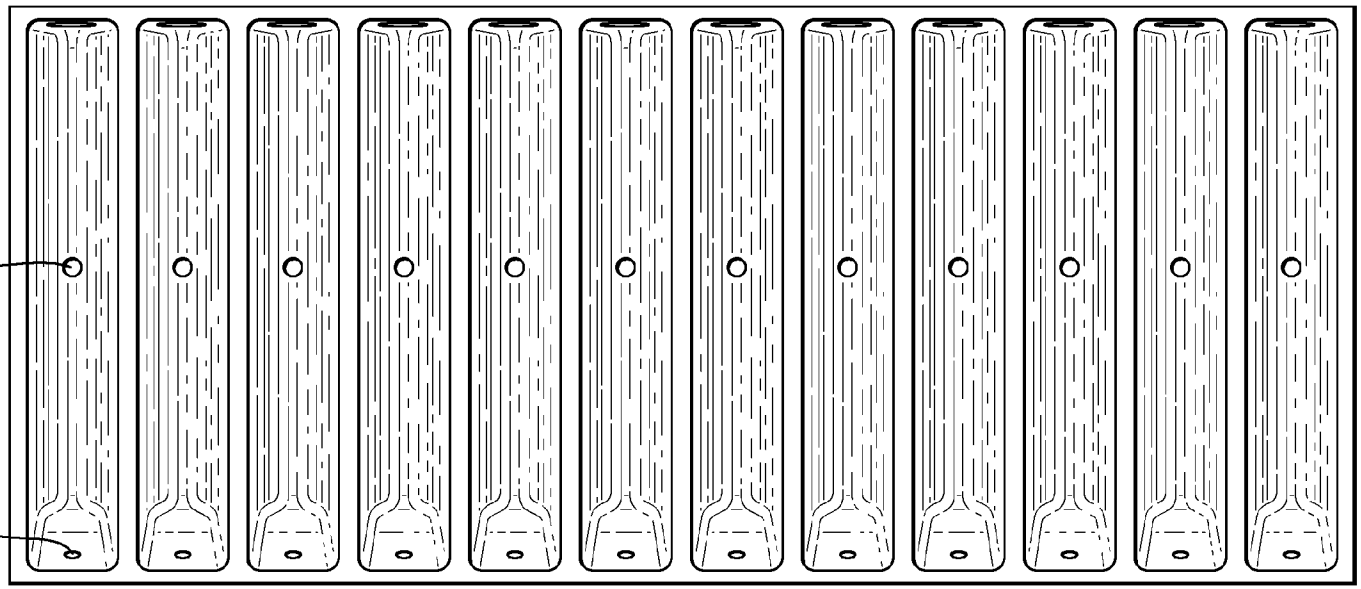
Figure 11C:
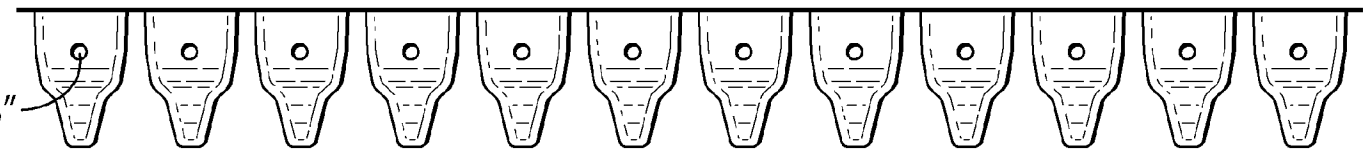
Figure 13A:
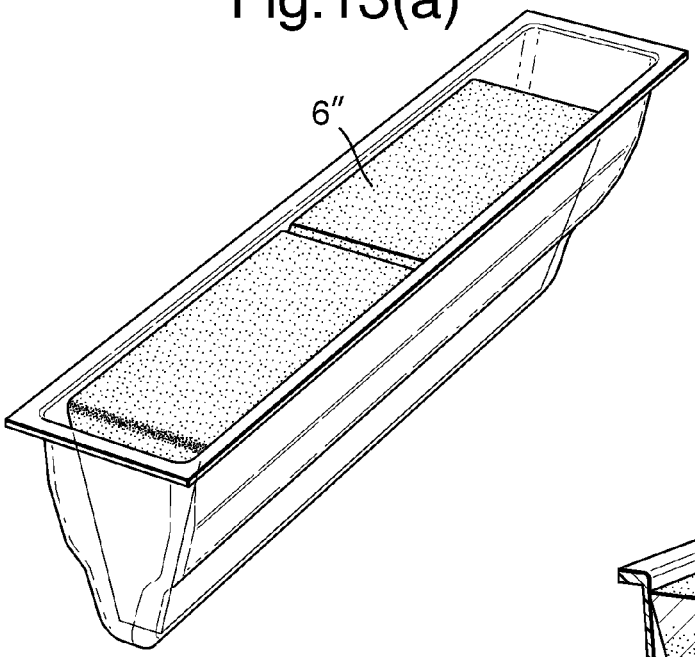
Figure 13B:
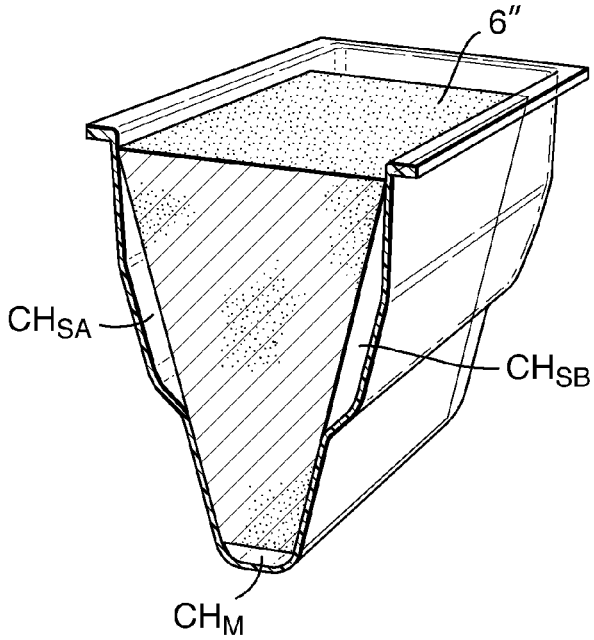
Figure 14:
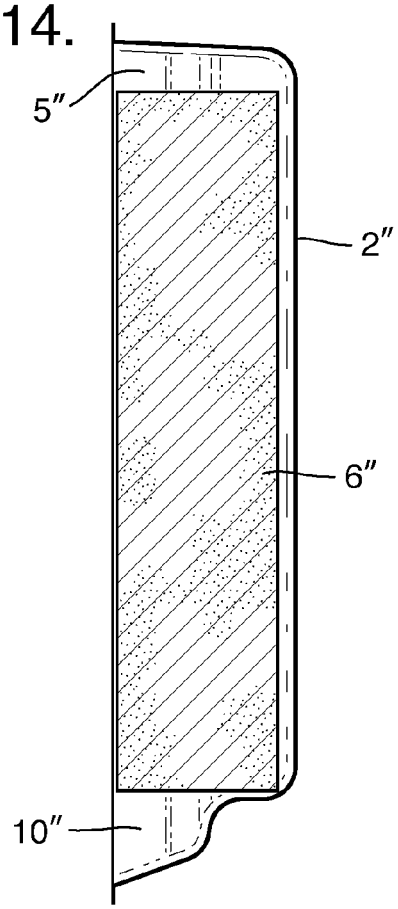
Figure 15:
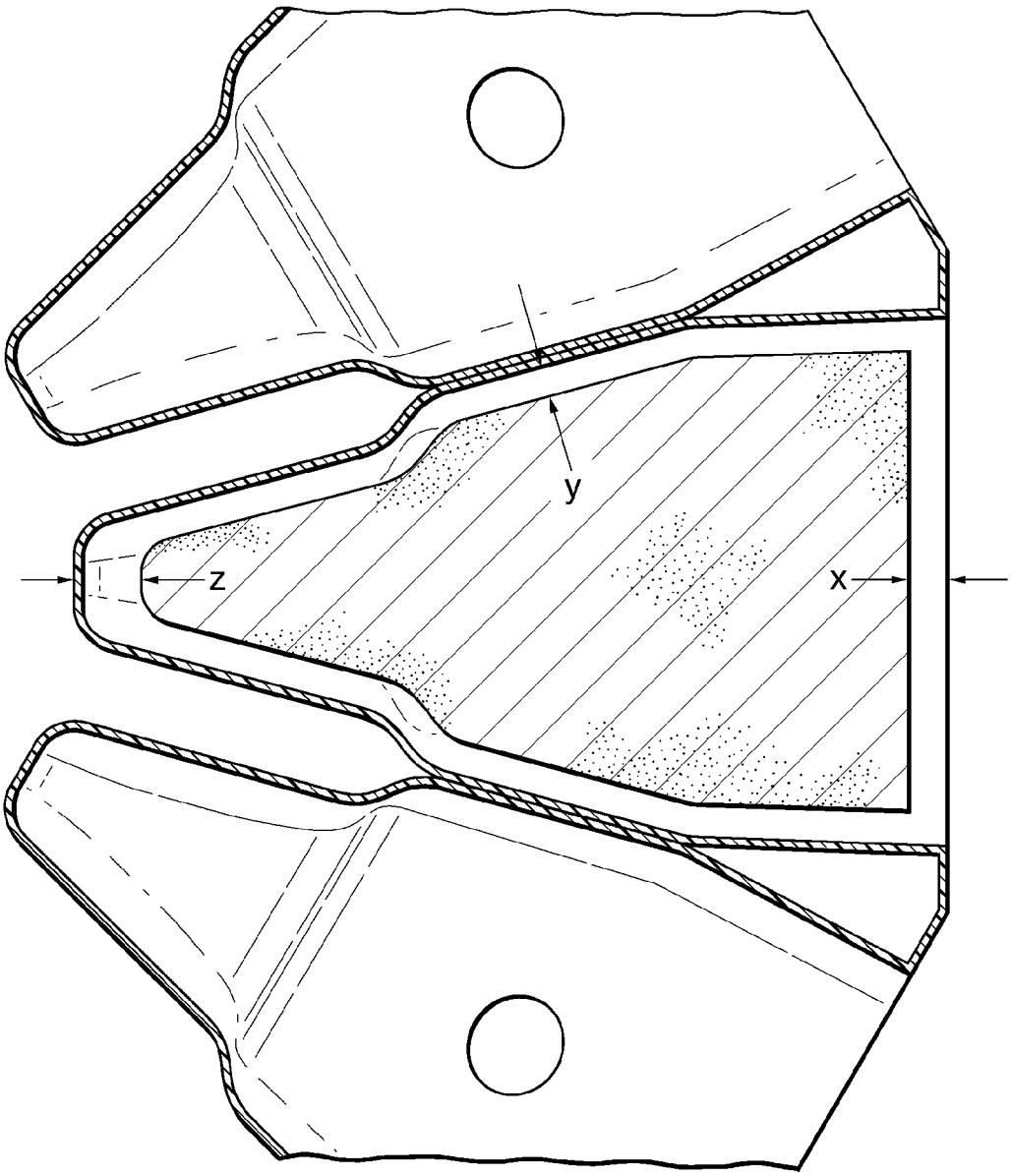

FIG. 8 shows in nested form a second embodiment of the article;

FIG. 9(*a*) shows in plan view and rack form the article of FIG. 8, while FIG. 9(*b*) shows the same article in side view and rack form;

FIG. 10 shows in side perspective view a single dosage element and associated chamber for a third embodiment of the article;

FIGS. 11(*a*), (*b*) and (*c*) show respectively top plan view, side plan view and bottom plan views of the article of the third embodiment in rack form;

FIG. 12 shows the article of the third embodiment in nested form;

FIG. 13(*a*) and FIG. 13(*b*) show respectively in perspective end view and in a perspective cross-sectional view a single dosage element and associated chamber of the an article according to the third embodiment;

FIG. 14 is a length-wise cross-sectional view of the dosage element and chamber of FIG. 13 showing the free space at top and bottom ends of the chamber; and FIG. 15 is a transverse section view of the dosage element and chamber of FIGS. 13 and 14 showing a peripheral free-space area of the chamber surrounding the dosage element.

Figure 2:
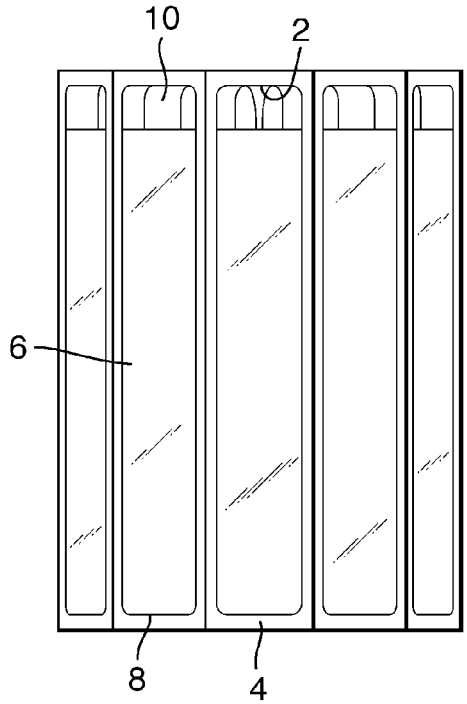
FIG. 2 shows the article of FIG. 1 in nested form, in side view.
Figure 3:
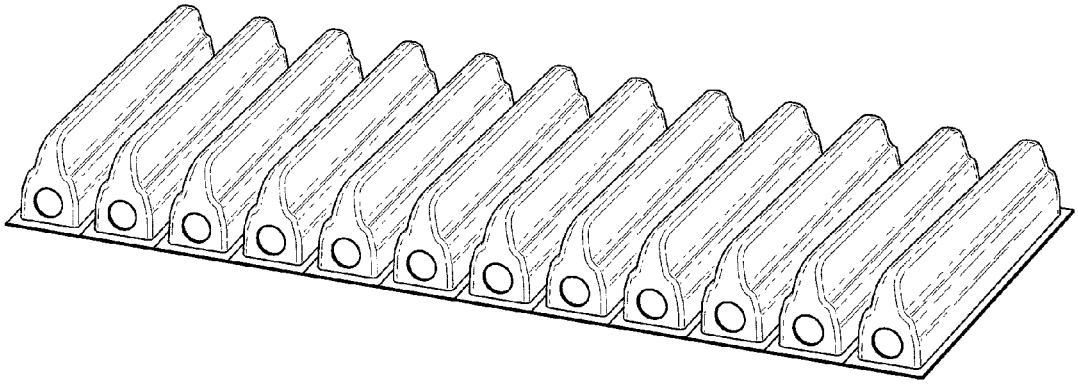
FIG. 3 shows the article of FIG. 1 in flat form.

The article of FIG. 1 is manufactured as a flat plastics tray of elongated blister chambers 2, shown in FIG. 3, comprising a thermoformed plastics tray. The open end of each blister chamber 2 is formed all around its perimeter with an endless flange 4 (which can be seen in FIG. 2). Dosage elements 6 comprising solid rods or sticks of a cleaning composition (intended in this embodiment to be used for cleaning in an automatic dishwasher machine) are introduced into the blister chambers. This can be done in different ways. For example in one embodiment the cleaning composition can be injected or cast into the chambers. However in this embodiment the rods or sticks comprising each dosage element 6 are pre-formed by injection moulding or extrusion, then cut to length, then introduced into the chambers. It may be noted that they are introduced into the chambers in the first embodiment and to fill each chamber to the bottom end 8, but to leave a space 10 at the top end. In other, more preferred, embodiments to be discussed later however, there is also left free space between a lowermost extent of the dosage element 6 and the base of the chamber. This space 10 is left so that water can enter the chamber, via opening 12 in the upper end wall of the chamber. In this embodiment each such opening 12 is circular, and 8 mm in diameter. An identical opening (not shown) is formed in the lower end wall of the article, to allow water and entrained or dissolved cleaning composition to exit the chamber.

Once all of the chambers have been provided with the rods or sticks of cleaning composition (by whatever means) a backing sheet 14 is laid over the open ends, and secured to the flanges 4. The backing may be adhered thereto by any convenient means, for example by heat or adhesive.

Next, the flat article, now in the form of a rack or linear array of rods or sticks, may be curled into its nested form shown in FIG. 1. In this embodiment the nested form is a generally cylindrical array. It may be retained in its nested form by a piece of adhesive tape 16.

The backing may be printed on its outwards-facing side with information, for example a trade mark, with product get-up, and/or with usage information.

Figure 4:
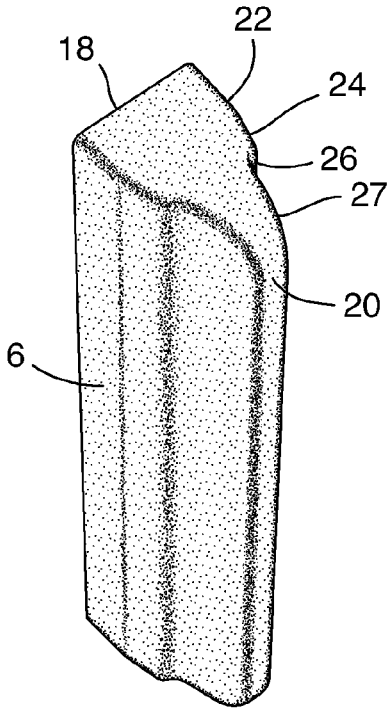
FIG. 4 shows the dosage element of FIG. 3 in plan view.

As shown in FIG. 4, each rod or stick—and correspondingly each blister, has a flat base wall 18 abutting the backing sheet 14. From the base wall 18, each rod or stick, and each blister, generally tapers to a narrower distal end wall 20. The side walls initially taper gradually, as at 22, 24, then undergo a somewhat abrupt inward dislocation 26, then taper at an intermediate rate (between that of the side wall portion 22 and the dislocation 26) at 27, until the distal end wall 20 is reached.

The rods or sticks may be regarded as having the general shape of a triangular prism (i.e. trigonal). To be more precise, as noted above the side walls taper in a discontinuous manner.

It will be noted that the rods or sticks are located on the backing sheet with a separation 28 between them, at their base walls 18.

It may further be noted that the rods or sticks have a separation 30 between them, at their distal end region, when in their nested form.

The backing sheet has, as a result of the mould into which it is thermoformed during manufacture, preferential fold lines 32. These fold lines 32 are aligned with the spacings 28 between the rods or sticks.

The end result of these features is as follows, and can be clearly seen in FIG. 1: when the article is formed into its nested shape the backing sheet is displaced about its fold lines 22, in an articulated manner. This nesting or folding is permitted by the spacings 28 and 30; if the sticks or rods simply abutted against each other the operation would not be permitted, due to physical obstruction. As can be seen in FIG. 1 the spacings 30 in the distal end regions may remain even in the nested form (though obviously narrowed).

In use, the article of the invention is a refill which is supplied in its nested form shown in FIG. 1, and also FIG. 5*a*. In that nested from it is inserted into a holder, shown in FIG. 5*b*. The holder is a cylindrical tub having a hub-like axial projection 40 extending upwards from its base substantially the whole axial length of the tub. Projecting outwardly from the projection 40 are four fins 42, set at 90° intervals. The fins extend approximately four-tenths of the radial distance of the holder.

The holder has a hanging handle 44.

The bottom wall of the holder is a large opening (not shown).

The holder has a lid shown in FIG. 5*c*. The lid has a central indexing device 46 surrounded by a sieve 48, to allow particulate-free water to enter the holder. The central indexing device has a push button 50 and, around it, a dial 54 carrying numbers, equalling the number of rods or sticks of cleaning composition. Each time the dishwasher is to be used, the user presses the button to advance the control dial by one number, bringing the next rod or stick of cleaning into use. This is done by rotating an apertured disc within the lid by one position so that water entering the holder must pass through the aperture thereof, now in alignment with the next rod or stick. Water enters the appropriate blister through the opening 12 which is aligned with the opening within the lid. The water may fill the spacing 10 above the rod or stick. The rod or stick is soaked by the water and dissolves and/or crumbles away, leaving the blister through the bottom opening.

Somewhat surprisingly, we have found that excellent dissolution of the rods or sticks is achieved by this method. It might have been expected that dissolving dosage elements of the cleaning composition by directing water to one end of them in an axial or lengthwise direction might be an inefficient method. In fact, dissolution or dispersion is excellent and the arrangement is very space-efficient, in not taking up very much of the "footprint area" available within the dishwashing machine.

As can be seen in FIG. 6, when the article is located within the tub of the holder the fins 42 are located within spacings 30 of the nested article. The tolerance of the fins in the spacings 30 is not large and in this way it is assured, that the rods or sticks, and the upper openings 12, are in the correct orientation, to align with the opening within the lid.

FIG. 7 shows the fully assembled device.

As was apparent from the discussion above, the first embodiment utilises identically sized holes top and bottom.

Such a formation, whilst it has been described as suitable for use within a push button device may also advantageously be utilised within an automatically indexing device as driven by, for instance, a wax motor.

There will now be described with reference to FIGS. 8 and 9 a particular formation of article that has been found to be of great utility. In the description which follows, reference numerals utilising a prime symbol (e.g. X') are included and where such a notation is used in combination with a number that has been used previously, then this is used to denote an equivalent or similar item.

The article of FIGS. 8 and 9 is intended for use within a multi-dosing device when the device is of such a construction as to allow water to access the chambers 2' from both above and below. In this particular case, the article in question is for use within a wax motor driven device. However, the particular features of the driving mechanism itself are not relevant to the understanding of the use and construction of the article herein described, merely the fact that water may access only one dosage element 6' over the course of a single wash cycle and that this water may access the dosage element from either above (via an upper opening 12') or below (via a lower opening 13').

In contrast to the first embodiment described above, it should be noted that the dosage element 6' of FIG. 8 does not extend downwardly so far as to fill a bottom area of the chamber 2', but instead there is a free space area 5' as well as there being a free space area 10' at an upper part of each chamber 2' above each dosage element 6'.

There is also provided in this embodiment a free space channel (not shown—but described in connection with a third embodiment later) which links said upper free space 10' to said lower free space 5'.

The idea and purpose behind providing such free space areas as mentioned above is to ensure that there is water flow throughout the length of the chamber 2' as soon as possible after commencing a wash cycle and that a maximum amount of surface area of the dosage element 6' can be contacted by such water flow.

In this embodiment, the apertures top and bottom have a relatively large size compared to the top surface area of the chamber 2'. For example, the diameter of the top and bottom holes may be each around 8 mm (i.e. have a surface area of around 50 $mm^2$), this being on a chamber having a total upper surface of, say, 130 $mm^2$. Providing such relatively large apertures both top and bottom 12', 13' as shown in FIGS. 8 and 9 is suitable for use in devices where a relatively large amount of water can be collected by the water collection area of the device lid or in circumstances where water can access the dosage element directly from the bottom hole 13'. However, in devices where a strictly limited amount of water is available, an alternative design of chamber inlet/outlet may be required. Such a variation will now be described in relation to a third embodiment of article as set out in FIGS. 10 through 15. In describing this embodiment a double prime notation (X") is utilised.

Referring initially to FIG. 10, there is shown in perspective view a chamber 2", containing a dosage element 6". As can be seen from the Figure, there is an upper opening 12", a lower opening 13" and an intermediate opening 17". Also, there is an upper space 10" between the top part of the dosage element 6" and a top wall of the chamber 2", so as to provide some free space between the upper opening 12" and the dosage element 6". There is also, a lower free space 5" underneath the dosage element 6", and above a lower most part of the chamber 2", so as to provide a gap between the lower opening 13" and the dosage element 6". Similarly, there is a channel of free space joining the free space 10" at the top of the chamber, to the free space 5" at the bottom of the chamber 2". In fact, this channel is arranged to run around a substantial portion of the exterior periphery of the dosage element 6", but it is particularly important that the middle opening 17", is spaced from the dosage element 6". The configuration of the various different holes within the chamber 2", may also be seen quite clearly from FIGS. 11*a* through 11*c*, which show respectively top plan view, side plan view, and bottom plan views of an empty chamber 2", featuring, respectively, the upper openings 12", middle openings 17", and lower openings 13".

FIG. 12 is a view of a nested rack of dosage elements, and in particular shows plan detail from above.

FIGS. 13*a* and 13*b*, show the dosage element 6" and chamber 2" of FIG. 10, but show in particular areas in which there is free space defining the channel CH, running from top to bottom within the chamber. It will be seen that this channel is provided by the internal dosage element 6" having a different formation, to the formation of the chamber 2". In particular, the chamber 2" tapers, to a narrower section adjacent to a front longitudinally running portion near to the middle opening 17", whilst the dosage element in this region begins to taper, but then ends abruptly so as to provide mid-channel portion $CH_M$, similarly, the formation of side portions of the chamber 2" deviates from the formation of side walls of the dosage element 6", so as to form side channels $CH_{SA}$ and $CH_{SB}$. Referring now to FIG. 15, the channel linking the top free space 10" and bottom free space 5" are shown as having widths X, y and z at various portions thereof.

There will now be described, in more detail, the relative sizes of the various different openings 12", 13", 17". In multi-dosing detergent delivery devices of the type defined by the present invention, it is necessary to ensure complete dissolution of detergent in the cartridge chamber 2", during a main wash, where limited resources of water might be available.

The principle behind providing the three different holes in the third embodiment, is to ensure that water which has entered the chamber, does not leave that chamber 2", too quickly. By ensuring that water remains in the chamber for a given period of time, partial filling of the chamber 2" with water occurs, so that the dosage element 6" is to some extent immersed in water. For this reason, providing a relatively small opening 13" at the base of the chamber 2", compared to the water inlet hole provided by the upper opening 12", provides a variation in available flow rates. Of course, in dishwashers and programs in which there is a high level of available water, providing simply a large hole at the top of a chamber, and a small hole at the bottom of the chamber could easily allow the chamber 2" to completely fill up the chamber with water. In the worst case, water could build up in the chamber, to the water inlet hole and then enter neighbouring chambers (which is of course highly undesired). For this reason, another hole 17" has been introduced between the upper and lower openings so as to allow the water to exit from the chamber 2" once the chamber 2" has filled up to a given level, here it is shown as being half way. This combination of holes leads to very good dissolution of the material of the dosage element 6", even with low amounts of available water.

In all cases, it is preferred that all openings have a significant distance from the detergent so as to minimise blockages. The various channels and spaces provided within the chamber 2" ensure this.

Preferred hole diameters for the upper opening 12", middle opening 17", and lower opening 13" are approximately 6 mm, 3 mm and 2.5 mm respectively. Of course, these holes may have various different ranges, but the main important feature is that the top hole, is larger than the bottom hole, with the middle hole generally having an area intermediate that of the top and bottom hole.

Embodiments of the invention may include each chamber either including a single dosage element or a compound (e.g. dual) dosage element formation—such as the type shown in FIG. 13 (*a*). In either case, the dosage element is in total of around between 10 and 20 ml in volume (preferably 13 to 16 ml), whilst the chamber total volume is preferentially in the range of 12 to 40 ml, most preferably 15 to 20 ml.

In the present invention, there have been described various different arrangements for providing different locations and sizes of holes to the chamber 2". It will be appreciated that different designs and cross sections of chamber and dosage element may be utilised, whilst still falling within the terms of the present invention. Also, whilst preferred embodiments of the invention are referred to as being provided on a rack of a nestable formation, it will be appreciated that the general principles regarding hole sizes and location for a chamber containing a dosage element may be applied to other situation and chamber types.

The invention claimed is:

1. An article comprising a rack of dosage elements of a cleaning composition and chambers adapted for use in a ware washing machine, wherein said chambers comprise a container for said dosage element and at least an upper opening and a lower opening for permitting ingress and egress of water/wash liquor to/from the chamber, and further wherein said chambers are retained on a common backing material and further wherein said rack is formable into a nested form.

2. An article according to claim 1, wherein each chamber has two openings at opposite ends adapted to permit water/wash liquor to enter at one end (the upper end in use) and leave at the other end (the lower end in use), carrying with it dissolved or broken away cleaning composition.

3. An article according to claim 1 wherein said upper opening has an area at of at least 10 $mm^2$.

4. An article to claim 3, wherein said upper opening has an area in the range of 30 $mm^2$, up to 70 $mm^2$.

5. An article according to claim 4, wherein said upper opening is approximately 50 $mm^2$.

6. An article according to claim 2, wherein the lower opening is of substantially the same size as the upper opening.

7. An article according to claim 2, wherein said upper hole is larger than said bottom hole.

8. An article according to claim 7, wherein said chamber comprises a middle opening intermediate said upper and lower openings.

9. An article according to claim 8, wherein said middle opening is larger than said lower opening and smaller than said upper opening.

10. An article according to claim 8, wherein said upper opening has an area in the range of 15 $mm^2$ to 40 $mm^2$.

11. An article according to claim 10, wherein said upper opening has an area of approximately 28 $mm^2$.

12. An article according to claim 8, wherein said lower opening has an area in the range of 3 $mm^2$ to 8 $mm^2$.

13. An article according to claim 12, wherein said lower opening has an area of approximately 5 $mm^2$.

14. An article according to claim 8, wherein said middle opening has an area in the range of 5 $mm^2$ to 10 $mm^2$.

15. An article according to claim 14, wherein said middle opening has an area of approximately 7 $mm^2$.

16. An article according to claim 1, wherein said rack is in the form of a parallel array of elongate chambers containing solid dosage elements.

17. An article according to claim 1, wherein said article is made in a flat form, and then formed into the nested form, and inserted into a holder, located, or to be located, in a ware washing machine.

18. The article according to claim 1, wherein the nested form is generally cylindrical.

19. A multiple dosing ware washing product comprising an article according to claim 1, in nested form, retained as a refill within a holder, located in a dishwashing machine.

20. A method of making an article according to claim 1, comprising the steps of:

forming a tray comprising a rack of cavities,
introducing a cleaning composition into the cavities,
sealing the cavities with said backing sheet, and
forming the article into a nested form.

21. A method of washing wares in a ware washing machine, the method comprising the steps of:

inserting an article according to claim 1 containing a plurality of dosage elements into said holder,
operating the ware washing machine,
removing the article after all of the dosage elements within the article are spent, thereafter inserting a new article, and operating the ware washing machine.

* * * * *